US009297274B2

(12) United States Patent
Mariotti

(10) Patent No.: US 9,297,274 B2
(45) Date of Patent: Mar. 29, 2016

(54) TURBOMACHINE ELECTRIC CONNECTION AND METHOD

(75) Inventor: Gabriele Mariotti, Lucca (IT)

(73) Assignee: Nuovo Pignone S.P.A., Florence (IT)

( * ) Notice: Subject to any disclaimer, the term of this patent is extended or adjusted under 35 U.S.C. 154(b) by 971 days.

(21) Appl. No.: 13/332,238

(22) Filed: Dec. 20, 2011

(65) Prior Publication Data

US 2012/0163962 A1 Jun. 28, 2012

(30) Foreign Application Priority Data

Dec. 23, 2010 (IT) ..... CO2010A0067

(51) Int. Cl.
*F01D 25/00* (2006.01)
*F01D 25/16* (2006.01)

(52) U.S. Cl.
CPC ..... *F01D 25/16* (2013.01); *F05D 2240/51* (2013.01); *Y10T 29/49117* (2015.01)

(58) Field of Classification Search
CPC ..... F01D 25/16; F05D 2240/51
USPC ..... 290/52; 415/13, 116, 177, 182.1
See application file for complete search history.

(56) References Cited

U.S. PATENT DOCUMENTS

| | | | | |
|---|---|---|---|---|
| 3,069,133 | A | 12/1962 | Swearingen | |
| 4,023,920 | A | 5/1977 | Bachler et al. | |
| 4,082,376 | A | 4/1978 | Wehde et al. | |
| 4,616,980 | A * | 10/1986 | Carpenter | 417/357 |
| 5,248,239 | A | 9/1993 | Andrews | |
| 5,627,420 | A * | 5/1997 | Rinker et al. | 310/87 |
| 6,897,587 | B1 * | 5/2005 | McMullen et al. | 310/90.5 |
| 8,651,838 | B2 * | 2/2014 | Birkenstock et al. | 417/423.4 |
| 2007/0063596 | A1 | 3/2007 | Akutsu et al. | |
| 2007/0132327 | A1 | 6/2007 | Brunet | |
| 2008/0031732 | A1 | 2/2008 | Peer et al. | |
| 2008/0252077 | A1 * | 10/2008 | Myers | 290/52 |
| 2009/0015012 | A1 * | 1/2009 | Metzler et al. | 290/52 |
| 2009/0016911 | A1 | 1/2009 | Noelle | |
| 2009/0250933 | A1 | 10/2009 | Delf | |

FOREIGN PATENT DOCUMENTS

| | | |
|---|---|---|
| EP | 2017435 A2 | 1/2009 |
| RU | 2277693 C1 | 6/2006 |

OTHER PUBLICATIONS

Italian Search Report which is dated Aug. 4, 2011 and which was issued in connection with the Italian Patent Application No. CO2010A000067 which was filed on Dec. 23, 2010.
Unofficial English Translation of Chinese Office Action and Search Report issued in connection with corresponding CN Application No. 201110460426.1 on Sep. 2, 2014.
Russian Office Action issued in connection with corresponding RU Application No. 2011151505 on Oct. 1, 2015.

* cited by examiner

*Primary Examiner* — Igor Kershteyn
*Assistant Examiner* — Woody A Lee, Jr.
(74) *Attorney, Agent, or Firm* — GE Global Patent Operation

(57) ABSTRACT

A turbomachine includes an expander; a central region having a first end attached to the expander; a compressor attached to a second end of the central region; an electrical device provided inside the central region; and an electrical connection including a first part and a second part, the first part being configured to be removably attached directly to the second part. The first part is configured to be removably attached to an external surface of an external casing of the central region, and the second part is configured to be fixedly attached to a bundle.

31 Claims, 11 Drawing Sheets

TURBOMACHINE ELECTRIC CONNECTION AND METHOD

BACKGROUND OF THE INVENTION

1. Field of the Invention

Embodiments of the subject matter disclosed herein generally relate to methods and systems and, more particularly, to mechanisms and techniques for electrically connecting various parts of a turbomachinery to an external device.

2. Description of the Prior Art

During the past years, the importance of turbomachines in various industries has increased. A turbomachine may include one or more of a compressor, expander, turbine, pump, etc. The turbomachines are used in engines, turbines, power generation, cryogenic applications, oil and gas, petrochemical applications, etc. Thus, there is a need for improving the efficiency of the turbomachines.

One turbomachine often used in the industry includes a compressor connected to an expander. Such a turbomachine may be employed, e.g., for recovering methane, natural gas, and/or liquefied natural gas (LNG). The recovery of such gasses would reduce emissions and reduce flare operations during the loading of LNG onto ships.

A turboexpander made by General Electric (Rotoflow) is illustrated in FIG. 1. Such machine 10 includes a compressor 12, an expander 14 and a main center section 16. The compressor 12 includes an impeller 18 and the expander 14 includes an impeller 20. The two impellers 18 and 20 are connected to each other via a shaft 22. The shaft 22 is supported, for example, by magnetic bearings 24. The magnetic bearings 24 need, for example, power for being able to perform the bearing function. Thus, the magnetic bearings 24 are connected through electrical wires 26 to a terminal box 28. The terminal box 28 is located inside a casing 30 of the main center section 16. An electrical cable 32 connects the terminal box 28 to, e.g., a power source 34. A seal 36 may be used to seal an inside of the casing 30 from an outside where the electrical cable 32 exits the casing 30.

The seal 36 is configured to prevent gasses processed by the compressor 12 and/or expander 14 to escape outside the turbomachine 10. Such gasses are under pressure and may be toxic and thus, they may harm the operator of the turbomachinery and/or the environment.

However, the arrangement described in FIG. 1 requires an extended time for maintenance. This is so because, for example, if the bearing system 24 needs to be replaced, the compressor 12 needs to be removed from the main center section 16, then an operator has to reach the terminal box 28 and to physically disconnect the electrical wires 26 from the terminal box 28 prior to removing the bearing system 24. These steps are time consuming given the size and weight of the components of the turbomachine 10.

Accordingly, it would be desirable to provide systems and methods that reduce a time for maintaining a turbomachine.

BRIEF SUMMARY OF THE INVENTION

According to an exemplary embodiment, there is a turbomachine that includes an external casing; a cartridge removably provided inside the external casing; and an electrical connection. The electrical connection has a first part fixedly connected to the cartridge and a second part movably connected to the external casing. The second part is configured to move relative to the first part and to electrically connect and disconnect with the first part.

According to another exemplary embodiment, there is a turbomachine that includes an expander; a central region having a first end attached to the expander; a compressor attached to a second end of the central region; an electrical device provided inside the central region; and an electrical connection including a first part and a second part, the first part being configured to be removably attached directly to the second part. The central region includes a bundle provided inside an external casing of the central region, the bundle including rotating parts of the compressor and the expander and the bundle being configured to be axially removed from the external casing. The first part is configured to be removably attached to an external surface of the external casing of the central region, and the second part is configured to be fixedly attached to the bundle.

According to still another exemplary embodiment, there is a turbomachine that includes an external casing configured to accommodate a compressor, an expander and a central region; an expander cover configured to be attached to the external casing for closing an expander side of the external casing; a compressor cover configured to be attached to the external casing for closing a compressor side of the external casing; a barrel configured to be attached to an inside of the external casing and to include moving parts of the expander, the compressor and the central region; and an electrical connection including a first part and a second part, the first part being configured to be removably attached directly to the second part. The first part is configured to be removably attached to an external surface of the external casing of the central region, and the second part is configured to be fixedly attached to the barrel.

According to still another exemplary embodiment, there is a turbomachine that includes an external casing configured to accommodate a compressor or an expander; a first cover configured to be attached to the external casing for closing a first opened side of the external casing; a second cover configured to be attached to the external casing for closing a second opened side of the external casing; a barrel configured to be attached to an inside of the external casing and to include moving parts of the expander and/or the compressor; and an electrical connection including a first part and a second part. The first part is configured to be removably attached directly to the second part, the first part is also configured to be removably attached to an external surface of the external casing, and the second part is configured to be fixedly attached to the barrel.

According to yet another exemplary embodiment, there is a method for assembling a turbomachine. The turbomachine includes inserting a bundle into a central region, the bundle being configured to be axially removed from an external casing of the central region and the bundle including an electrical device; connecting an expander to the central region; connecting a compressor to the central region; and electrically connecting a first part of an electrical connection to a second part of the electrical connection, the first part being configured to be removably attached directly to the second part. The first part is configured to be removably attached to an external surface of the external casing, and the second part is configured to be fixedly attached to the bundle.

BRIEF DESCRIPTION OF THE SEVERAL VIEWS OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a turboexpander. However, the embodiments to be discussed next are not limited to this turbomachine, but may be applied to other turbomachines.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a turboexpander that includes a compressor connected to an expander may have instrumentation or bearings that are electrically connected to an outside of the machine. Such a connection may include a male part and a female part. One of the male or female part is provided on an external casing of the turboexpander in such a way that a medium under pressure inside the turboexpander is prevented to escape to outside. The other of the male or female part is attached to an inside casing (e.g., barrel or cartridge or bundle) that is configured to slide out of the external casing. The part provided on the external casing may be removed from outside the turboexpander so that the internal casing is free to slide out of the external casing.

For simplicity, the following exemplary embodiments are discussed with regard to a compressor and an expander having a barrel configuration in a vertical split configuration. However, the novel aspects of the exemplary embodiments are also applicable to horizontally split machines or other types of machines. In addition, the novel embodiments are applicable to a turbomachine that includes only a compressor, or only an expander, or only a turbine, or only an engine, etc. In another words, although most of the exemplary embodiments to be discussed next include a combination of a compressor and an expander, the novel features are applicable to a turbomachine that has a single component, e.g., a compressor, an expander, a turbine, etc.

Figure 1:
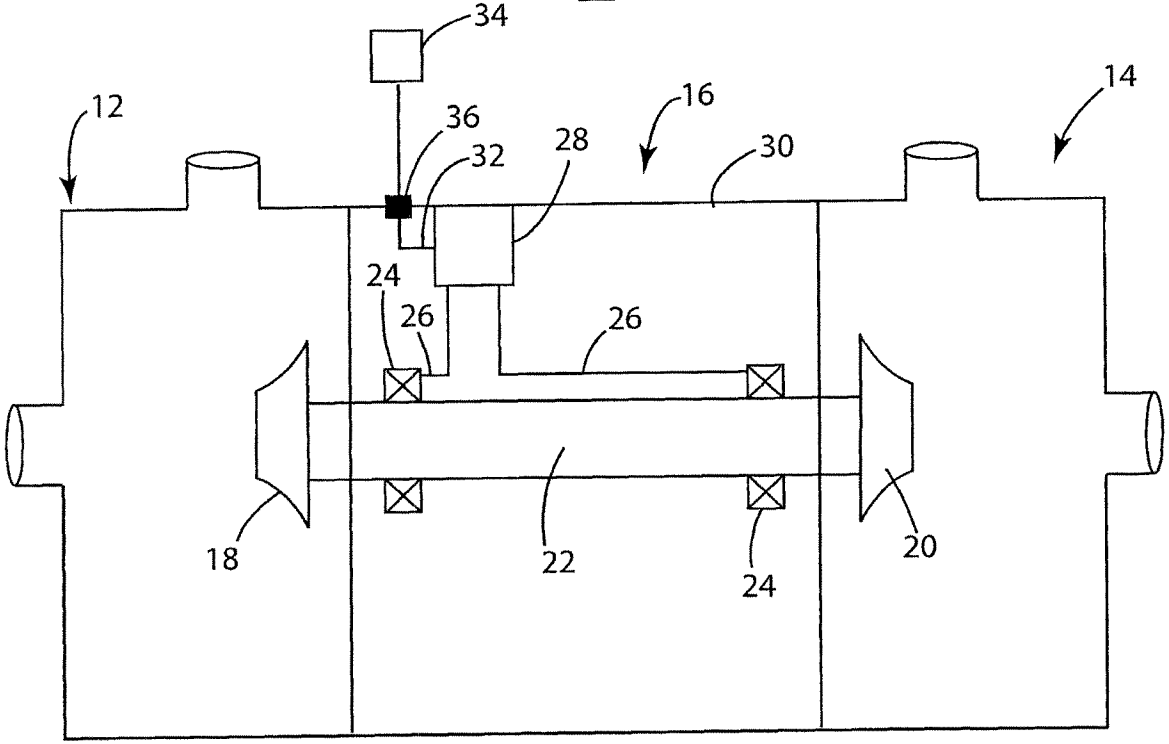
Figure 1 (Background Art)
FIG. 1 is a schematic diagram of a conventional turboexpander.
Figure 2:
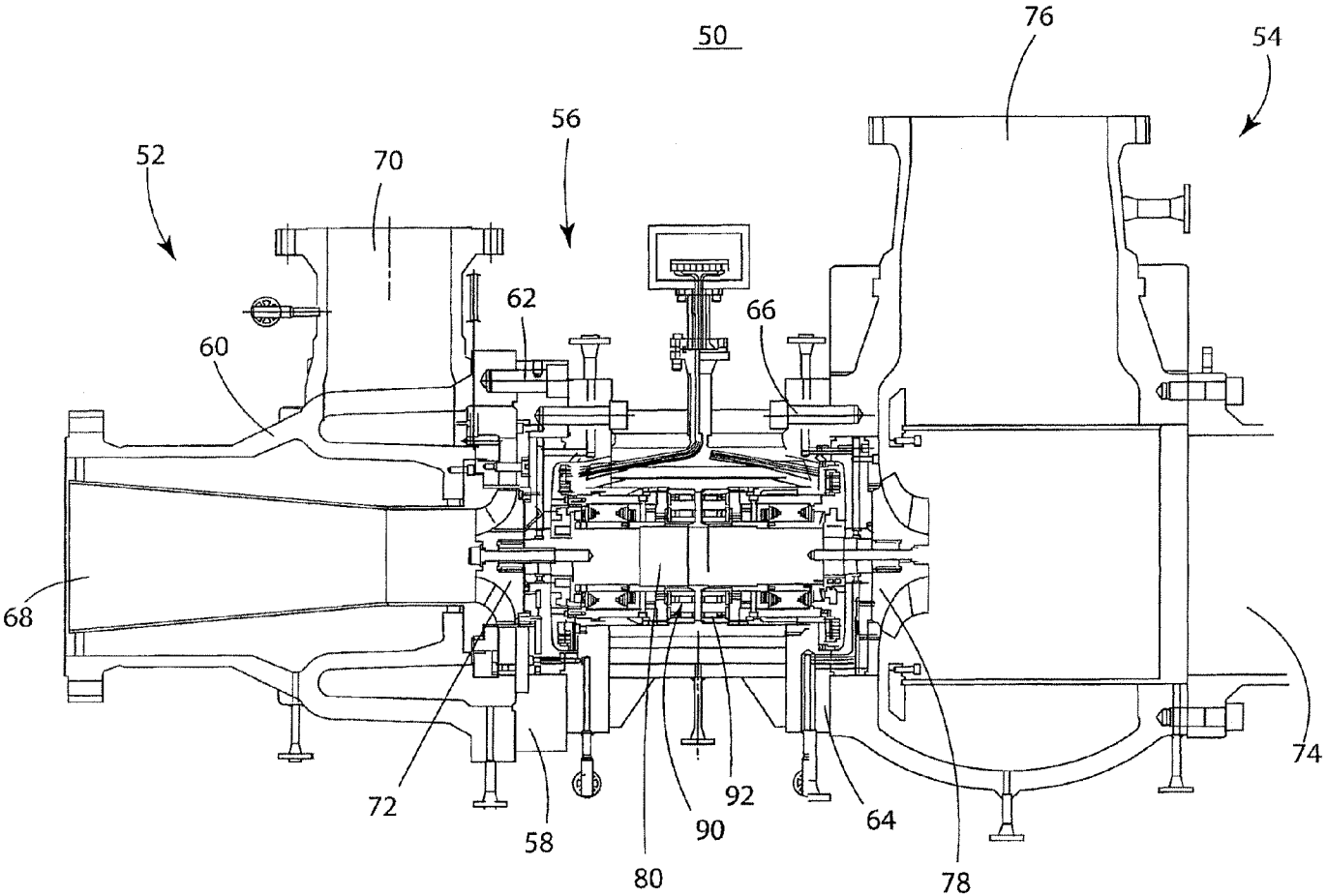
FIG. 2 is a schematic diagram of a turboexpander according to an exemplary embodiment.

According to an exemplary embodiment illustrated in FIG. 2, a turboexpander 50 includes an expander 52, a compressor 54, and a central region 56. The expander 52 is attached to the central region 56 through a flange 58 that is attached to a casing 60 of the expander 52. The flange 58 is attached via one or more bolts 62 to the central region 56. Similarly, the compressor 54 is attached through a flange 64 to the central region 56 by bolting the flange 64 with bolts 66.

Expander 52 includes an inlet 68 and an outlet 70. A medium is introduced through the inlet 68 to an impeller 72. Although FIG. 2 shows only one impeller 72 (e.g., one stage) the expander may have more than one stage. The same is true for the compressor 54, which is shown in the figure having an inlet 74, an outlet 76 and an impeller 78.

The compressor impeller 78 and the expander impeller 72 may be attached to a same shaft 80. To facilitate the rotation of the shaft, a bearing system 90 may be provided inside the central region 56. The bearing system 90 may include one or more magnetic bearings 92. For a better illustration of the bearing system 90 and other components of the turboexpander, FIG. 3 shows only the central region 56 and parts of the expander 52 and the compressor 54.

Figure 3:
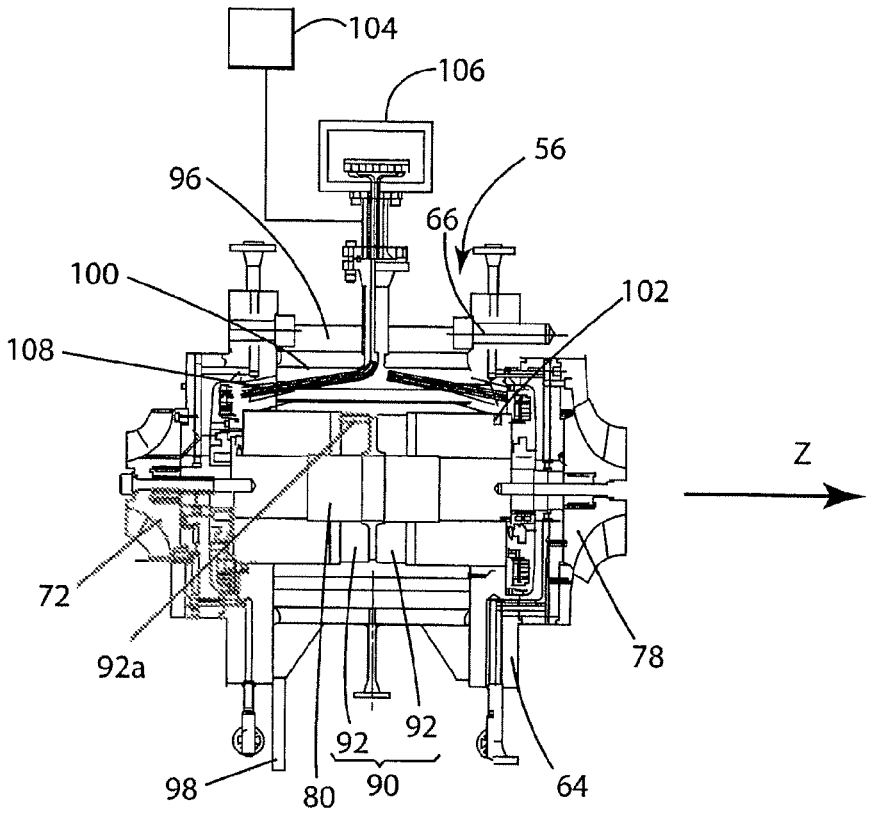
FIG. 3 is a detailed schematic diagram of a part of a turboexpander according to an exemplary embodiment.

FIG. 3 shows that the central region 56 has an external casing 96 that is fixed, e.g., has legs 98 that are configured to contact the ground and support the entire central region 56. Most of the parts provided inside the central region 56 are provided in a bundle 100 that is configured to be removably attached to the external casing 96. In other words, the bundle 100 is configured to slide along an axial, where the axial direction is defined by the longitudinal axis Z of the turbomachine. The bundle 100 may include the magnetic bearings 92, part of the rotor 80, instrumentation 102, etc. The instrumentation 102 may include pressure sensors, temperature sensors, oxygen sensors, vibration sensors, speed sensors, etc. Both the instrumentation 102 and the magnetic bearings 92 may need power from an external power source 104 or to communicate with an external device 106. The power source 104 and the external device 106 may be located outside the turbomachine as shown in FIG. 3. Electrical wires connect the power source 104 and/or the external device 106 with the instrumentation 102 and/or magnetic bearings 92.

Figure 4:
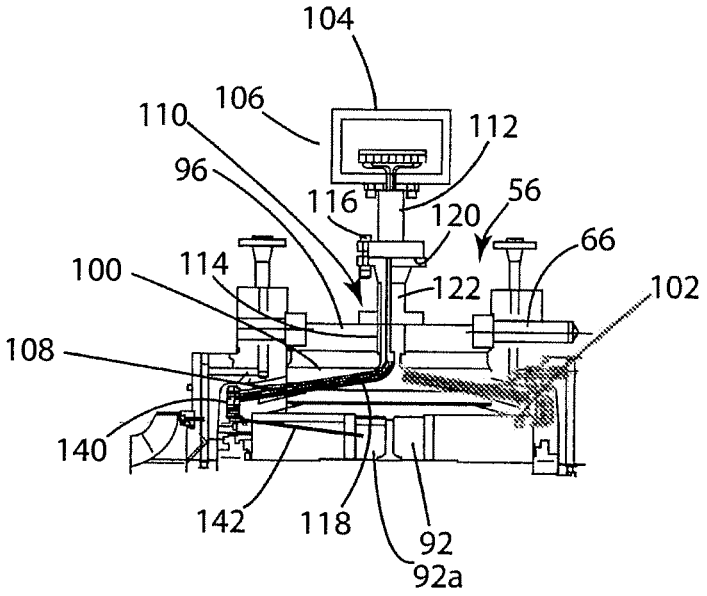
FIG. 4 is a schematic diagram of an electrical connection of a turboexpander according to an exemplary embodiment.

An electrical connection 110 for connecting an inside of the turboexpander with an outside is discussed now with regard to FIG. 4. The electrical connection 110 has a male part 112, which in this exemplary embodiment is a first part, and a female part 114, which in this exemplary embodiment is a second part. However, optionally, the first part may be the female part 114 and the second part may be the male part 112. The male part 112 is configured to match the female part 114 and to achieve the electrical connection between the male part 112 and the female part 114. For example, the male part 112 may have one or more pins and the female part 114 may have one or more sockets that are configured to receive the pins. Although FIG. 4 shows the male part 112 being outside the turboexpander and the female part being inside the casing 96, the situation may be reversed in another turbomachine.

The male part 112 is configured to be attached to the external casing 96 with bolts 116 or other means. However, the male part 112 should be removable from an outside of the external casing 96 for those situations when the turbomachine needs to be disassemble. The female part 114 is attached to the bundle 100. As a high pressure gas is present inside the casing 96 and may be in contact with electrical wires 118 that connect the female part 114 to the magnetic bearings 92 or instrumentation 102, a seal 120 is provided between the male part 112 and the external casing 96 for preventing the escape of the gas. In one application, the seal 120 may be partially placed inside a groove formed in a flange 122 of the male part 112. This ensures that the high pressure gas from inside the casing 96 does not escape outside.

FIG. 4 also shows the wires 118 being attached to the bundle 100 and connecting the female part 114 to, for example, a terminal box 140. The terminal box 140 is also attached to the bundle 100. Corresponding wires are provided from the terminal box 140 to each desired element. For example, FIG. 4 shows electrical wires 142 connecting the terminal box 140 to a magnetic bearing 92*a*. The electrical wires 142 may be used not only to provide electrical power to the magnetic bearings and/or the instrumentation but also to transmit signals and commands between the terminal box and these elements. In one application, the wirings 118, 142, and the terminal box 140 are attached to the bundle 100. Thus, after the female part 114 is disconnected from the male part 112 from outside the machine, the bundle may be taken out axially together with all the wiring inside the turbomachine, without the need that an operator manually disconnects electrical connections inside the machine.

Figure 5:
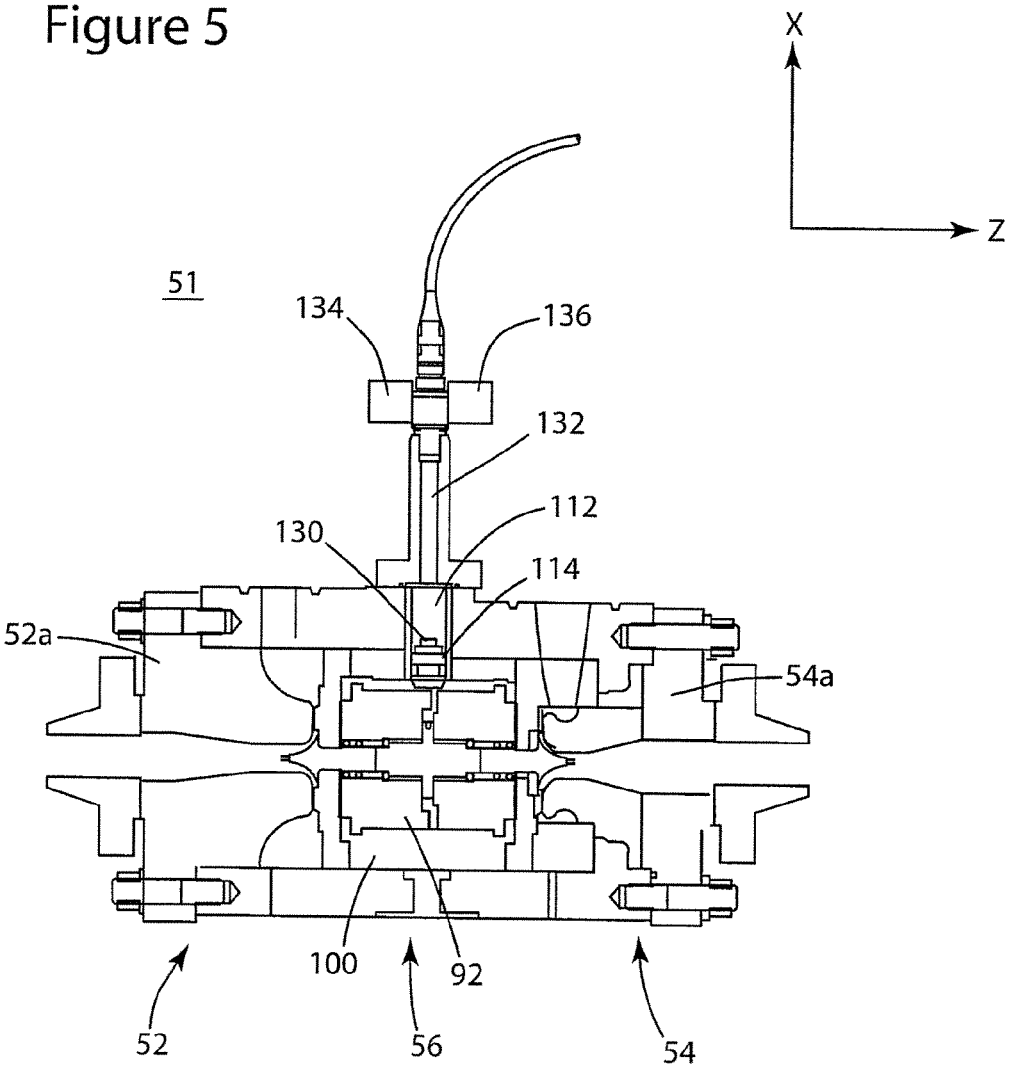
FIG. 5 is a schematic diagram of a barrel turboexpander according to an exemplary embodiment.

In an exemplary embodiment illustrated in FIG. 5, a barrel turbomachine 51 has an electrical connection including the male part 112 and the female part 114. The male part 112 may have a multipin head 130 configured to move along axis X towards and away from the female part 114. For example, a rod 132 may be connected to the multipin head 130 and move this head along axis X. The movement of the rod 132 may be performed manually by the operator of the compressor, electrically by a motor 134 or hydraulically by a hydraulic device 136. Irrespective of whether the rod 132 is moved manually, electrically or hydraulically, this movement may be achieved from outside the turbomachine. In one application, the female part 114 is flush with an external surface of the bundle 100 so that the bundle 100 may slide along axis Z.

Thus, when access to the magnetic bearings 92 or other parts housed in the bundle 100 is required, the operator of the compressor simply disconnects the male part 112 from the female part 114 from the outside of the turbomachine and then can replace the entire bundle with a new one. In this way, the maintenance time of the turbomachine may be reduced between 30 and 50% comparative to a traditional maintenance process as there is no need to enter inside the central part 56 for disconnecting electrical wires.

Figure 6:
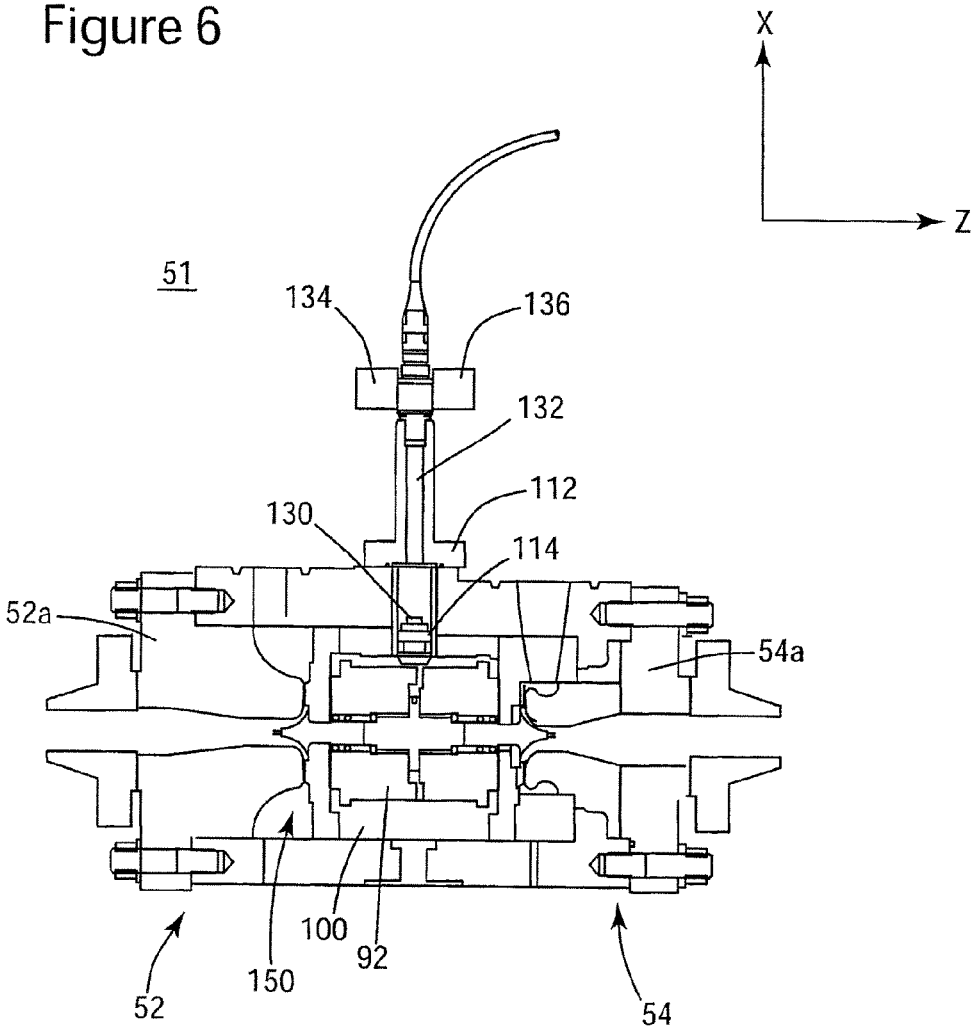
FIG. 6 is a schematic diagram of a barrel turboexpander according to an exemplary embodiment.

A disassembling process is now discussed with reference to FIG. 6. In this exemplary embodiment, the expander 52 has a cover 52*a* and the compressor 54 has a cover 54*a*. Either one of the covers 52*a* and 54*a* may be first removed to get access to bundle 100. Bundle 100 may be part of a cartridge 150. After the male part 112 is disconnected from the female part 114, and a few bolts (or other mechanisms) that maintain the bundle 100 attached to the cartridge 150, either the bundle 100 or the cartridge 150 may be removed from the turbomachine and may be replaced with a new one in order to minimize the down time of the turbomachine. After this step, the male part 112 is attached to the new female part 114 of the new cartridge 150, the cover 52*a* or 54*a* is attached back to the machine and the machine may be brought back on line.

Figure 7:
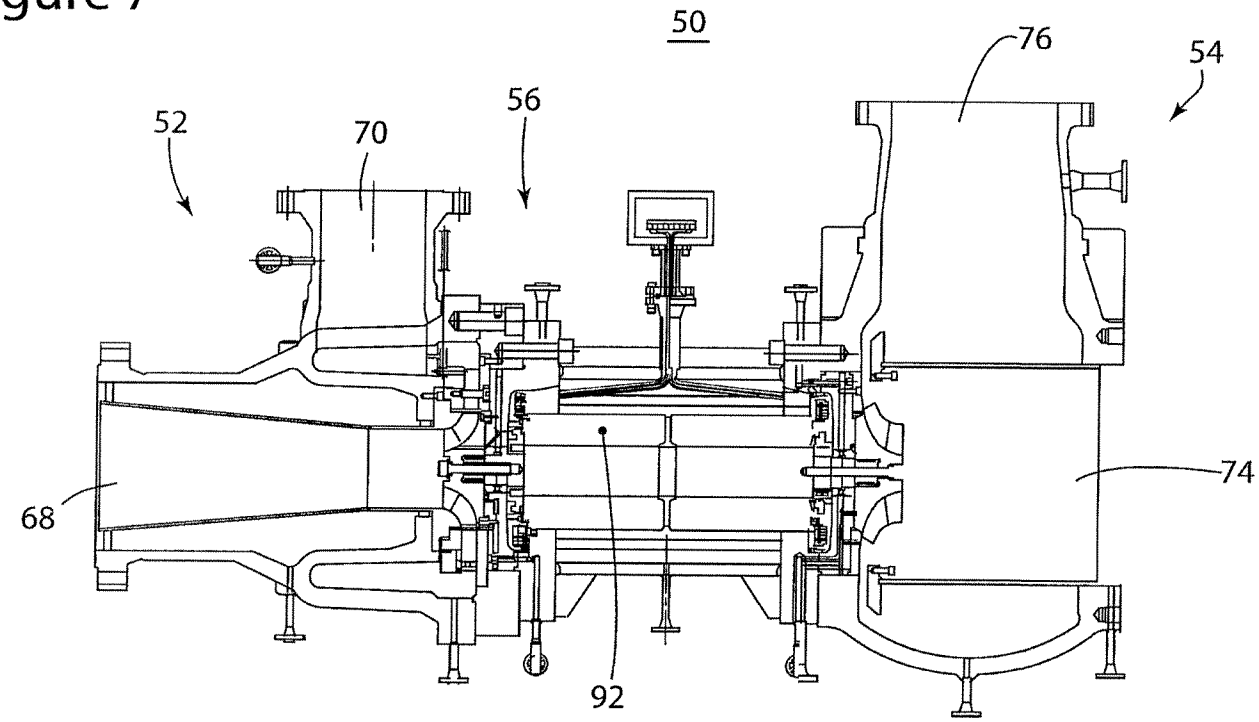
FIGS. 7-9 illustrate the disassemble of a turboexpander according to an exemplary embodiment.
Figure 8:
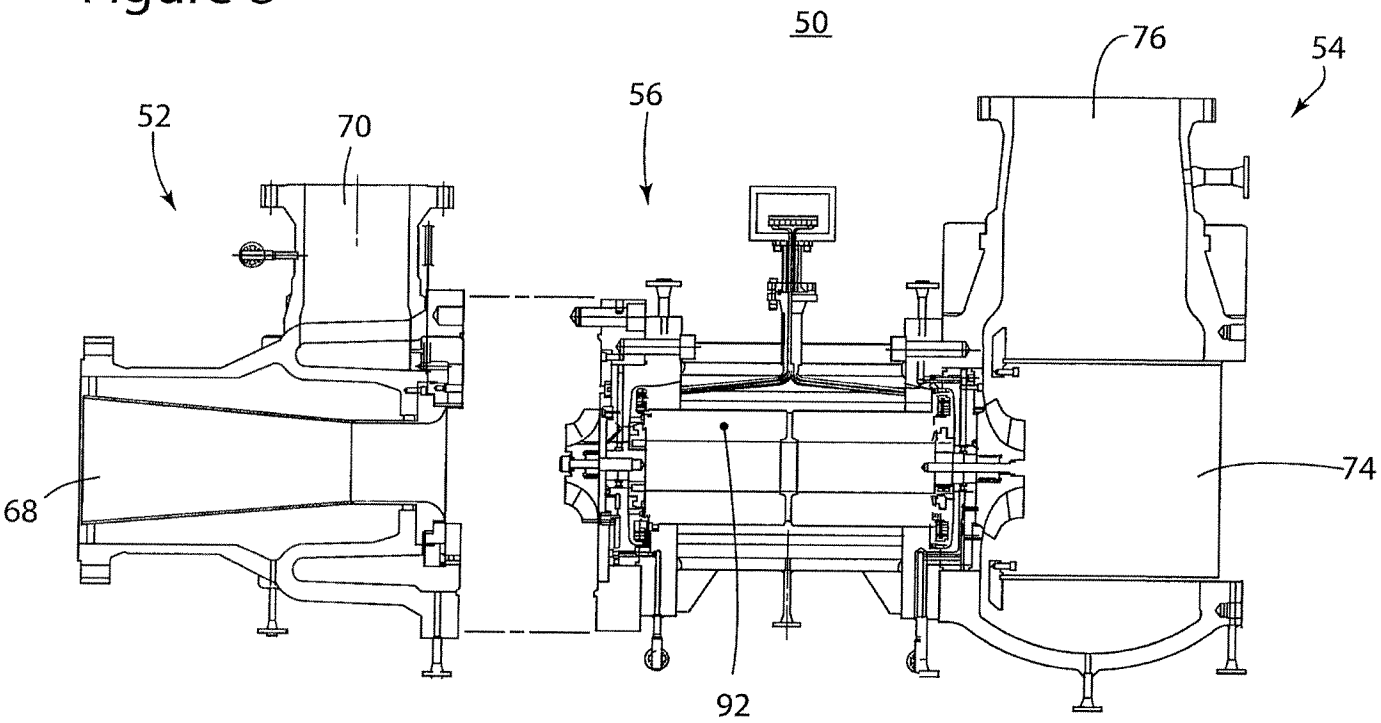
Figure 9:
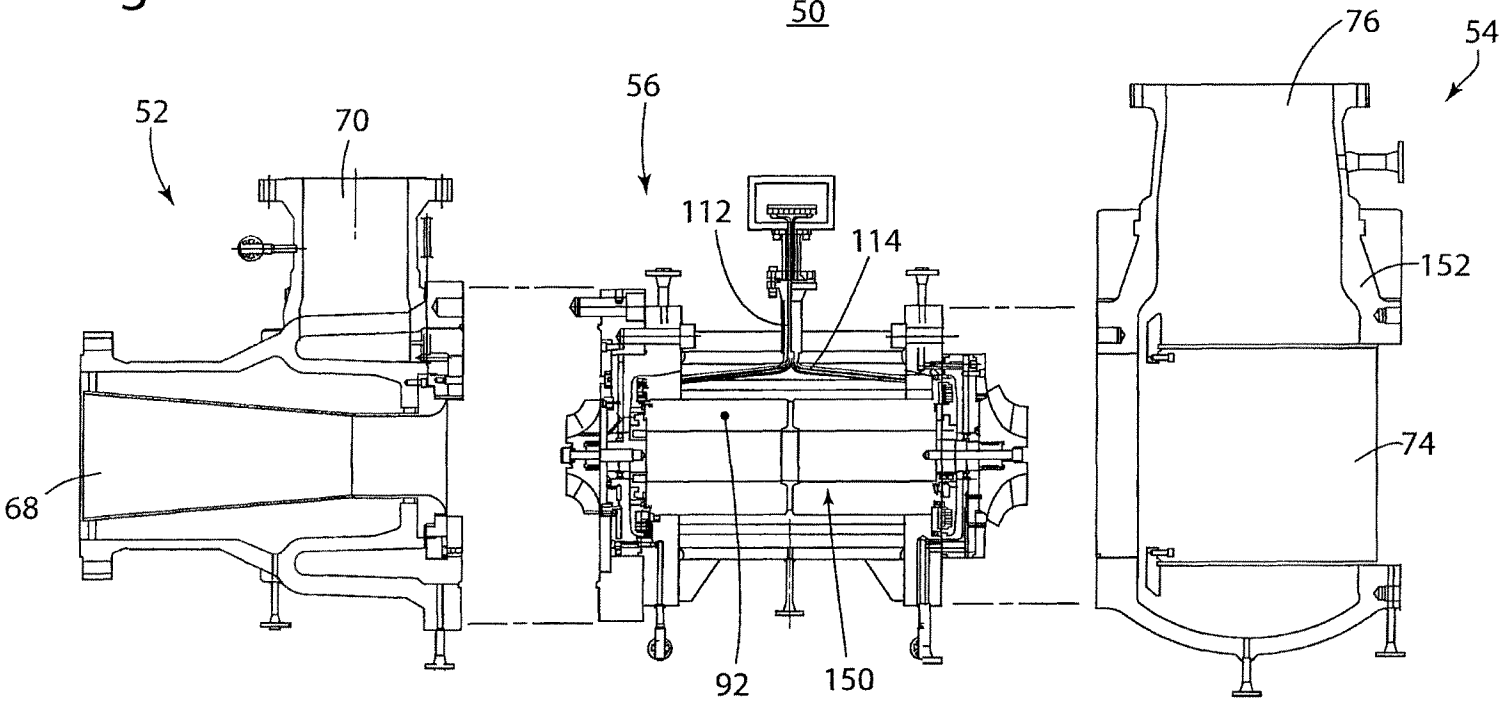

According to another exemplary embodiment illustrated in FIGS. 7-9, the disassembling of another turbomachine is now discussed. Suppose that a magnetic bearing 92 is faulty inside the turbomachine and it needs to be changed. The turboexpander 50 shown in FIG. 7 needs to be disassembled to get access to the faulty magnetic bearing. In a first step, piping connected to the inlet 68 and outlet 70 of the expander 52 needs to be removed. Once the expander 52 is free of these constraints, the expander is unbolted from the central region 56 and separated from the machine as shown in FIG. 8. It is noted that the weight of a compressor or expander may be in the order of tons to tens of tons and thus, the removal of such a large piece of equipment is not straightforward.

Prior to this step or subsequent to this step, the male part 112 of the electrical connection 110 is disconnected from the female part 114 to electrically disconnect the components of the central region 56 from the power source 104 or the device 106. The device 106 may include a processor capable to process various signals to be sent or received to and from the instrumentation 102 or the magnetic bearings 92. Then, the bundle 100 may be removed from the external casing 96 together with the rotating parts, bearings and seals and replaced with a new one.

In an alternative embodiment, the entire cartridge 150 may be removed from the casing 152 of the compressor 54 as shown in FIG. 9. In this application, the male part 112 and the female part 114 may remain connected to each other. A new cartridge may be brought in and attached to the expander and compressor in a reverse order relative to the one discussed above. It is noted that for both arrangements shown in FIGS. 8 and 9, the piping connected to the compressor 54 remain in place during the maintenance operation.

Figure 10:
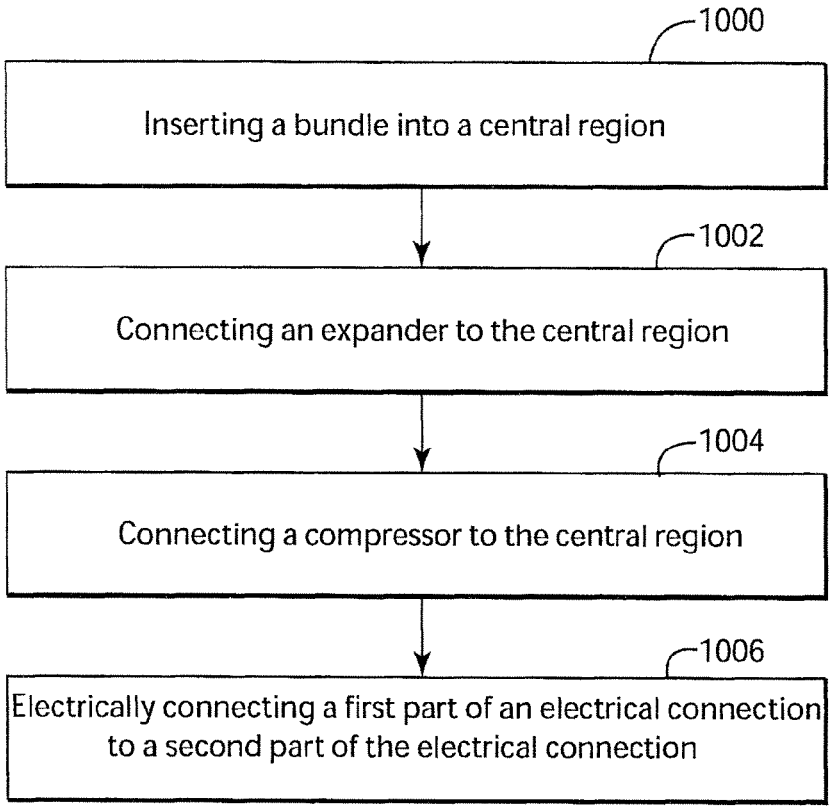
FIG. 10 is a flow chart illustrating a method for assembling a turboexpander according to an exemplary embodiment.

According to an exemplary embodiment illustrated in FIG. 10, there is a method for assembling a turbomachine. The method includes a step 1000 of inserting a bundle into a central region, the bundle being configured to be axially removed from an external casing of the central region and the bundle including an electrical device; a step 1002 of connecting an expander to the central region; a step 1004 of connecting a compressor to the central region; and a step 1006 of electrically connecting a first part of an electrical connection to a second part of the electrical connection, the first part being configured to be removably attached to the second part. The first part is configured to be removably attached to the external casing, and the second part is configured to be fixedly attached to the bundle.

Figure 11:
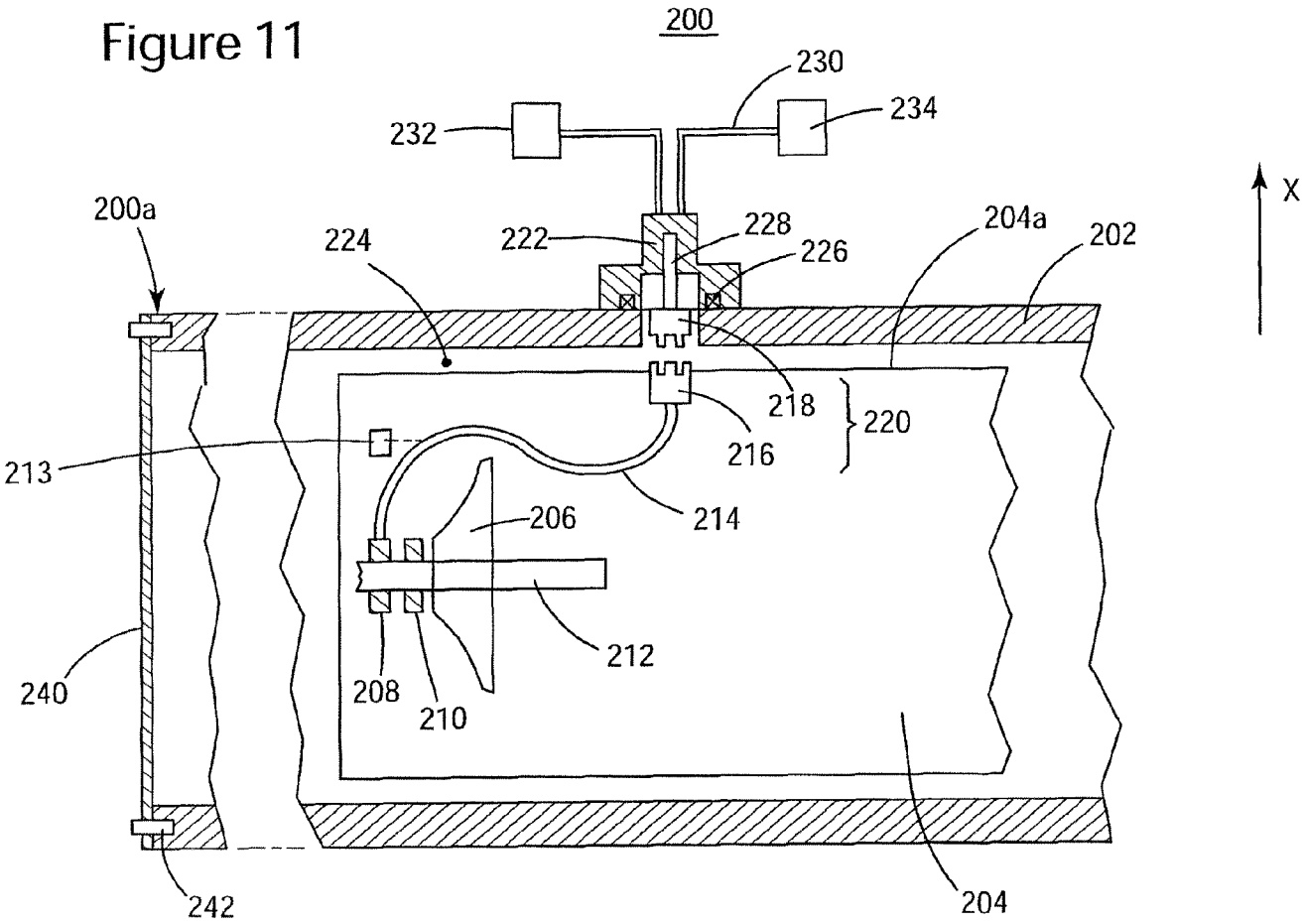
FIG. 11 is a schematic diagram of a compressor having an electrical connection according to an exemplary embodiment.

According to an exemplary embodiment illustrated in FIG. 11, a compressor 200 (e.g., a turbomachine) has an outer casing 202 configured to house a cartridge 204. The cartridge 204 may include one or more of the following components of the compressor: an impeller 206, a bearing system 208, a sealing system 210, a shaft 212, an electric device 213, etc. The electrical device 213 may be any instrument or sensor that typically is found inside a compressor. As the bearing system 208 may include magnetic bearings, power needs to be supplied to the bearing system 208. For this reason, a power supply line 214 is used to connect the bearing system 208 to a male (or female) part 216 of an electrical connection 220. The power supply line 214 may also connect the electrical device 213 to a power source outside the compressor. The power supply line 214 may be provided completely inside the cartridge 204. The electrical connection 220 also includes a female part 218. In one application, the part 216 may be the male part and the part 218 may be the female part.

The female part 216 is fixedly attached to the cartridge 204 while the male part 218 is connected to the exterior casing 202 in such a way that the male part 218 can move along direction X to connect or disconnect from corresponding female part 216. In this way, the electrical connection 220 may be switched on and off from an outside of the compressor. The male part 218 may be actuated from outside the compressor, either manually or by a dedicated device, e.g., key, electrical motor, hydraulic mechanism, etc.

In one application, all the electrical power supplies may be configured to enter the female part 216 so that when the compressor is disassembled, there is only one electrical connection 220 to be disconnected. In another application, the electrical connection 220 may be used to handle not only the power supply but also data communication.

The male part 218 is housed in a housing 222 that is removably connected (by known means, e.g., welding or bolts) to the external casing 202, on an outside of the casing. For ensuring that no fluid under pressure that exists in a chamber 224 inside the external casing 202 exits the external casing 202, appropriate seals 226 are placed at an interface between the housing 222 and the external casing 202. A rod 228 is shown inside the housing 222 for actuating the male part 218. Other mechanisms may be used to actuate the male part. Electrical conductors 230 are shown leaving the electrical connection 220 and connecting to various devices 232 and 234.

The compressor 200 may have at an end 200*a* of the external casing 202 a cap 240 that can be attached by bolts 242 to the external casing 202. In this way, when the compressor needs to be disassemble or assemble, the cap 240 may be removed, the electrical connection 220 may be disconnected and the entire cartridge 204 may be removed from the external casing 202 for maintenance or other necessary operations.

According to an exemplary embodiment, the female part 216 is flush with a surface 204*a* of the cartridge 204 or provided slightly away from the surface 204*a* (inside the cartridge 204) so that the cartridge 204 can easily slide relative to the external casing 202. In one application, the male part 218 is configured to partially enter into chamber 224 and/or the cartridge 204 in order to electrical connect with the female part 216. However, the male part 218 is also configured to retract when necessary, from the female part 216 such that the male part 218 does not touch the cartridge 202 and the cartridge may be removed from the external casing 202.

Most if not all off the advantages and features discussed with the previous embodiments may be applied to the device shown in FIG. 11. In addition, the turbomachine shown in FIG. 11 does not have to be a compressor, it may be an expander, a pump, a turbine, a motor, etc.

The disclosed exemplary embodiments provide a system and a method for more efficiently inserting or removing an internal bundle or cartridge from an external casing. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A turbomachine comprising:

an external casing;

a cartridge removably provided inside the external casing and having plurality of electrical elements; and an electrical connection having a first part removably attached to the external casing and a second part fixedly attached to the cartridge;

wherein the first part is configured to move relative to the second part, wherein one of the first part or the second part is a male part and the other of the first part or the second part is a female part; and wherein when the first part and second part are joined an electrical connection is established, and when the first part and second part are disjoined the electrical connection is interrupted, such that when the electrical connection is interrupted, the cartridge can be removed axially without manually disconnecting the plurality of electrical elements of the cartridge.

2. The turbomachine of claim 1, wherein the cartridge is cylindrical.

3. The turbomachine of claim 1, wherein the electrical connection is provided in a central part of the external casing.

4. The turbomachine of claim 1, further comprising:

a cap configured to close one end of the external casing.

5. The turbomachine of claim 4, wherein the cartridge is configured to slide out of the external casing when the cap is removed.

6. The turbomachine of claim 1, further comprising:

an electrical device provided inside the cartridge and configured to use electric power.

7. The turbomachine of claim 6, wherein the first part comprises plural pins configured to enter a socket in the second part to electrically connect the electrical device to a power source or a processor.

8. The turbomachine of claim 6, wherein the electrical evice is at least one of a magnetic bearing or a sensor.

9. The turbomachine of claim 6, further comprising:

electrical wires connecting the second part to the electrical device, wherein the electrical wires are fully inside the cartridge.

10. The turbomachine of claim 1, wherein the electrical connection comprises:

a seal provided between the first part and the external casing for preventing a gas from inside the external casing to escape outside.

11. The turbomachine of claim 1, wherein the second part is exposed to a gas to be processed by the compressor.

12. A turbomachine comprising:

an expander;

a central region having a first end attached to the expander;

a compressor attached to a second end of the central region;

an electrical device provided inside the central region having a plurality of electrical elements; and an electrical connection comprising a first part and a second part, the first part configured to be removably attached directly to the second part;

wherein the central region comprises a bundle provided inside an external casing of the central region, the bundle comprising rotating parts of the compressor and the expander and the bundle configured to be axially removed from the external casing;

wherein the first part is configured to be removably attached to the external casing of the central region;

wherein the second part is configured to be fixedly attached to the bundle; and wherein the first part is configured to move relative to the second part, one of the first part or the second part being a male part and the other of the first or second parts being a female part; and wherein when the first part and the second part are joined an electrical connection is established and when the first part and the second part are disjoined the electrical connection is interrupted, such that when the electrical connection is interrupted, the cartridge can he removed axially without manually disconnecting the plurality of electrical elements of the cartridge.

13. The turbomachine of claim 12, wherein the second part is flush with an exterior surface of the bundle.

14. The turbomachine of claim 12, wherein the first part is retractable.

15. The turbornachine of claim 12, wherein the first part is configured to move axially towards and away from the second part.

16. The turbomachine of claim 12, wherein the first part comprises plural pins configured to enter a socket in the second part to electrically connect the electrical device to a power source or a processor.

17. The turbornachine of claim 12, wherein the electrical device is at least one of a magnetic bearing or a sensor.

18. The turbomachine of claim 12, further comprising:

electrical wires connecting the second part to the electrical device, wherein the electrical wires are fully inside the bundle.

19. The turbomachine of claim 12, wherein the electrical connection comprises:

a seal provided between the first part and the external casing of the central region for preventing a gas from inside the central region to escape outside.

20. The turbotmachine of claim 12, wherein the second part is exposed to a gas to be processed by the compressor.

21. A turbomachine comprising:

an external casing configured to accommodate a compressor, an expander and a central region;

an expander cover configured to be attached to the external casing for closing an expander side of the external casing;

a compressor cover configured to be attached to the external casing for closing a compressor side of the external casing;

a barrel configured to be attached to an inside of the external casing and comprising moving parts of the expander, the compressor and the central region and a plurality of electrical elements; and an electrical connection comprising a first part and a second part, the first pal configured to be removably attached directly to the second part;

wherein the first part is configured to be removably attached to the external casing of the central region;

wherein the second part is configured to be fixedly attached to the barrel; and wherein the first part is configured to move relative to the second part, one of the first part or the second part being a male part and the other of the first part or the second part being a female part;

wherein when the first part and the second part are joined an electrical connection is established and when the first part and the second part are disjoined the electrical connection is interrupted, such that when the electrical connection is interrupted, the cartridge can be removed axially without manually disconnecting the plurality of electrical elements of the cartridge.

22. The barrel turbomachine of 21, wherein the second part is flush with an exterior surface of the barrel.

23. The barrel turbomachine of claim 21, wherein the first part is retractable.

24. The barrel turbomachine of claim 21, wherein the first part is configured to move axially towards and away from the second part.

25. The barrel turbomachine of claim 21, wherein the first part comprises plural pins configured to enter a socket in the second part to electrically connect an electrical device provided inside the barrel to a power source or a processor outside the barrel turbomachine.

26. The barrel turbomachine of claim 21, further comprising:

electrical wires connecting the second part to an electrical device provided in the barrel, wherein the electrical wires are fully inside the barrel.

27. The barrel turbomachine of claim 21, wherein the electrical connection comprises:

a seal provided between the first part and the external casing of the central region for preventing a gas from inside the central region to escape outside.

28. A turbomachine comprising:

an external casing configured to accommodate a compressor or an expander;

a first cover configured to be attached to the external casing for closing a first opened side of the external casing;

a second cover configured to be attached to the external casing for closing a second opened side of the external casing;

a barrel configured to be attached to an inside of the external casing and comprising moving parts of the expander or the compressor and haying a plurality of electrical elements; and an electrical connection comprising a first part and a second part, the first part configured to be removably attached directly to the second part;

wherein the first part is configured to be removably attached to the external casing, and wherein the second part is configured to be fixedly attached to the barrel: and wherein the first part is configured to move relative to the second part, one of the first part or the second part being a male part and the other of the first part or the second part being a female part, wherein when the first part and the second part are joined an electrical connection is established and when the first and the second parts are disjoined the electrical connection is interrupted, such that when the electrical connection is interrupted, the cartridge can be removed axially without manually disconnecting the plurality of electrical elements of the cartridge.

29. A method for assembling a turbomachine, the method comprising:

inserting a bundle into a central region, the bundle configured to be axially removed from an external casing of the central region and the bundle comprising an electrical device and a plurality of electrical elements;

connecting an expander to the central region;

connecting a compressor to the central region; and electrically connecting a first part of an electrical connection to a second part of the electrical connection, the first part configured to be removably attached directly to the second part;

wherein the first part is configured to be removably attached to the external casing, and wherein the second part is configured to be fixedly attached to the bundle; and wherein the first part is configured to move relative to the second part, one of the first part or the second part being a male part and the other of the first part or the second part being a female part, wherein when the first part and the second part are joined an electrical connection is established and when the first part and the second part are disjoined the electrical connection is interrupted, such that when the electrical connection is interrupted, the cartridge can be removed axially without manually disconnecting the plurality of electrical elements of the cartride.

30. The method of claim 29, further comprising:

electrically or hydraulically or manually axially moving the first part towards or away from the second part.

31. The method of claim 29, wherein the step of electrically connecting is performed after the steps of connecting the expander and the compressor.

* * * * *